US005360247A

United States Patent [19]

Vachter

[11] Patent Number: 5,360,247

[45] Date of Patent: Nov. 1, 1994

[54] DEVICE FOR SCOOPING ARTICLES FROM A SURFACE

[76] Inventor: Charles A. Vachter, 18343 French Prairie Rd., Woodburn, Oreg. 97071

[21] Appl. No.: 206,033

[22] Filed: Mar. 3, 1994

Related U.S. Application Data

[63] Continuation of Ser. No. 55,561, May 3, 1993, abandoned.

[51] Int. Cl.[5] ..... A01D 45/00; A01K 29/00

[52] U.S. Cl. ..... 294/1.4; 294/19.1; 294/55

[58] Field of Search ..... 294/1.3–1.5, 294/19.1, 19.2, 55; 15/104.8, 257.1–257.4, 257.6, 257.7; 56/328.1, 332; 209/417–419; 239/289

[56] References Cited

U.S. PATENT DOCUMENTS

| | | | |
|---|---|---|---|
| 2,270,632 | 1/1942 | Hasty | 294/19.2 |
| 2,810,252 | 10/1957 | Kelly | 294/19.2 X |
| 2,821,833 | 2/1958 | Axtell | 294/19.2 X |
| 3,046,044 | 7/1962 | Christle | 294/19.2 |
| 3,139,299 | 6/1964 | Bowen | 294/1.4 |
| 3,659,891 | 5/1972 | Pettenon et al. | 294/1.4 |
| 3,804,448 | 4/1974 | Schmieler | 294/1.4 |
| 3,937,509 | 2/1976 | Hufnagel | 294/1.4 |
| 4,119,337 | 10/1978 | Sherhandt | 294/1.4 |
| 4,383,710 | 5/1983 | Fehr | 294/1.4 |
| 4,447,082 | 5/1984 | Lindholm | 294/1.4 |
| 4,844,526 | 7/1989 | Young | 294/19.2 |

*Primary Examiner*—Johnny D. Cherry
*Attorney, Agent, or Firm*—Eugene M. Eckelman

[57] ABSTRACT

A cylindrical receptacle has an open front end and a closed rear end. A handle leads rigidly from a side wall of the receptacle in a lateral direction at approximately 45° from the longitudinal plane of the receptacle. In one embodiment the receptacle has longitudinal side openings of a length greater than one-half the length of the receptacle and of a dimension to hold scooped articles but to allow foreign material to fall or be shaken out. Another embodiment of the invention has a front fluted edge. In yet another embodiment, the receptacle has a closed side wall and the connection between the handle and the receptacle provides communication between the handle and the receptacle. In this embodiment the handle has a fitting at its free end for a garden hose whereby the receptacle can be cleaned by pressured water flowing through the handle. The connection for the handle projects a short distance into the receptacle and includes a spray head for efficiently directing the pressured water interiorly of the receptacle.

5 Claims, 2 Drawing Sheets

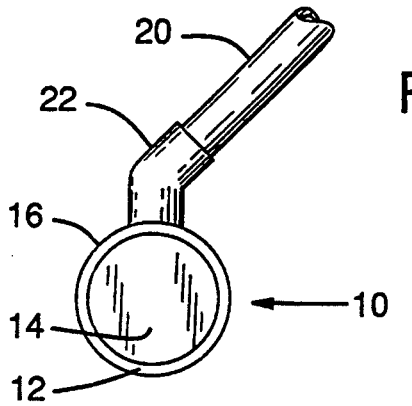
FIG. 2
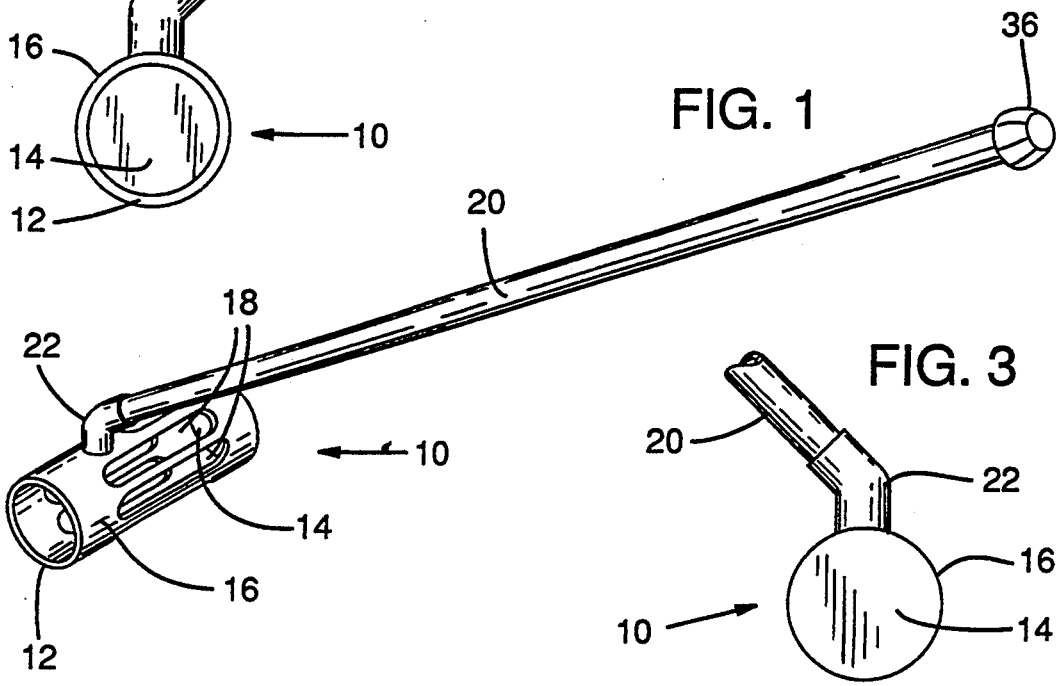
FIG. 1
FIG. 3
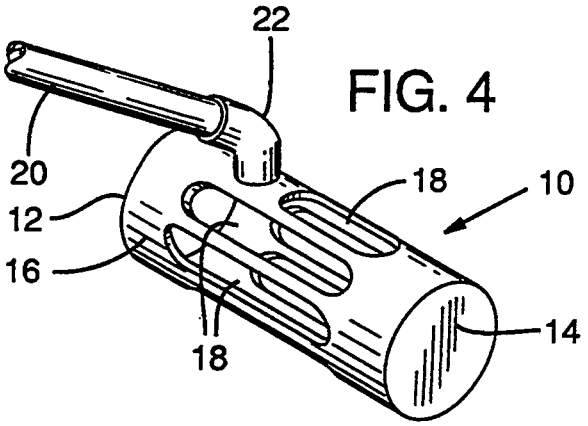
FIG. 4
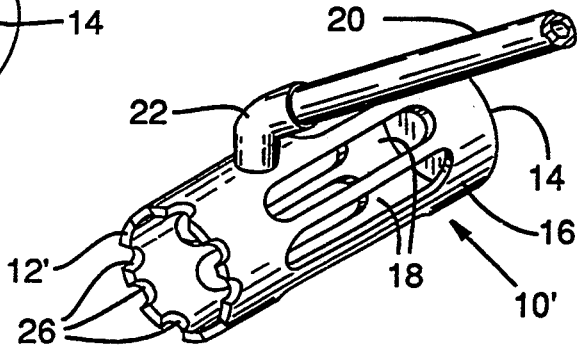
FIG. 5

DEVICE FOR SCOOPING ARTICLES FROM A SURFACE

This application is a continuation of application Ser. No. 08/055,561, filed May 3, 1993, now abandoned.

BACKGROUND OF THE INVENTION

This invention relates to new and useful improvements in devices for scooping articles from a surface.

Various devices have heretofore been devised for picking up articles from the ground surface. For example, hinged pans are well known for picking up floor sweepings, dog excrement, etc. Devices have also been made for other scooping purposes. For example, U.S. Pat. Nos. 2,810,252 and 2,821,833 show nut gathering devices employing hinged receptacles. The hinged support of the receptacle on the handle allows the receptacle to be positioned to its pickup position. Patents have also been directed to golf ball retrieving devices comprising pickup means on an elongated handle. Exemplary golf ball retrieving devices are shown in U.S. Pat. Nos. 3,046,044 and 4,844,526.

SUMMARY OF THE INVENTION

According to the present invention and forming a primary object thereof, a device is provided for scooping articles from the ground surface that includes improved structure and improved function for its intended purpose. More particularly, it is an object of the invention to provide a device having a rigid connection between the handle and a receptacle in an arrangement facilitating a positive and novel manipulation of the receptacle by a handle leading from the receptacle.

In carrying out these objects, a cylindrical body member in the form of a receptacle is provided having an open forward end and a closed rearward end. A handle leads rigidly from a wall of the body member adjacent the front for manipulation of the receptacle by a person in a forward motion to scoop articles from a surface into the open forward end. The handle projects at a selected angle relative to the longitudinal axis of the receptacle whereby when the receptacle is supported adjacent the ground by a person supporting it by its handle, said receptacle extends substantially parallel with the ground and can be readily manipulated to pick up an article. The leading edge of the receptacle may be fluted for ease of picking up articles under certain ground surface conditions. The device, with the same type of angled handle as noted above, also may employ an inside washing head comprising an extension of the handle which in this case is hollow and which is arranged for connection to a garden hose at its upper end. The washing head has selectively arranged outlet ports for thorough washing of the interior of the receptacle.

The invention will be better understood and additional objects and advantages will become apparent from the following description taken in connection with the accompanying drawings.

BRIEF DESCRIPTION OF THE DRAWINGS

FIG. 1 is an isometric view taken from the front of a first form of the invention.

FIG. 2 is a front elevational view.

FIG. 3 is a rear elevational view.

FIG. 4 is a fragmentary isometric view taken from the rear.

FIG. 5 is a fragmentary isometric view taken from the front of a modified form of the invention.

DETAILED DESCRIPTION OF PREFERRED EMBODIMENTS

Figure 7:
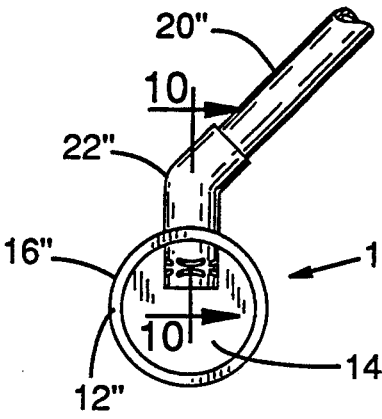
FIG. 7 is a front elevational view of the FIG. 6 embodiment.

With reference first to FIGS. 1–4, a first form of the invention is illustrated. It comprises a cylindrical body member in the form of a receptacle 10 having an open forward end 12 and a closed rearward end 14. The receptacle has a defining circular wall 16 forming an enclosure with a sufficient diameter to receive articles to be scooped from a surface. A particular function of this embodiment is for scooping up nuts, such as walnuts, for harvesting them.

Since walnuts and others are usually picked up off the ground, dirt and other foreign material will also be picked up along with the nuts. For this purpose, the defining wall 16 has openings 18 therein of a size which confine the nuts but which allow the foreign material to fall or be shaken out. The openings 18 preferably are elongated to extend at least through one-half the longitudinal dimension of the receptacle for best results. The lesser width of the openings 18 relative to the objects being picked up allows the objects to rest and engage edges of the openings and keep them from rolling out the front when more articles are picked up.

The association of the receptacle 10 with a supporting handle 20 therefor is important. That is, the handle is connected to the receptacle at a point adjacent the front, or at least forward of the center of gravity of the receptacle. Also the handle extends at a selected angle from the receptacle for a preferred manipulation of the device. With greater particularity, an elbow-type connection 22 for the handle leads from this forward point and provides connection for the handle laterally outwardly at approximately 45° from a vertical diameter of the receptacle. The handle may be removably attachable to the connection 22, as by a forced tapered fit or by threads.

With the handle leading from the receptacle as shown and described, the device can be held by the handle at ground level for scooping articles in a simplified forward movement of the receptacle. The offset position of the receptacle, due to the angled connection 22, positions the receptacle a short and spaced distance from the operator's feet for easy, clearance manipulation. Scooping movements are readily made longitudinally alongside the operator in a horizontal direction, or scooping movements can be readily made laterally across the front of the operator in such longitudinal direction. With a firm grip on the handle, the receptacle, being integral and rigid with the handle, can be leveled or tipped as desired and articles can be scooped into the front opening with ease. The device can be operated equally well by right or left-hand persons.

With reference to FIG. 5, which shows another embodiment of the invention, the front open end 12' of the receptacle 10' may have shallow notches 26 to form a fluted edge. This fluted edge facilitates more readily the scooping of nuts from a smooth surface.

Figure 6:
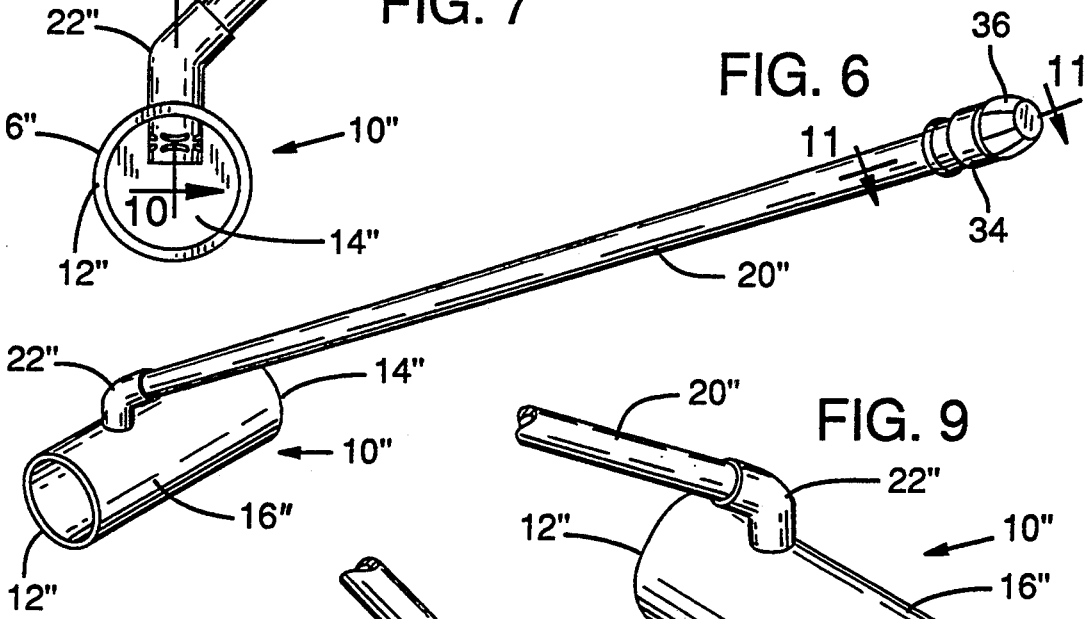
FIG. 6 is an isometric view taken from the front of another form of the invention.
Figure 9:
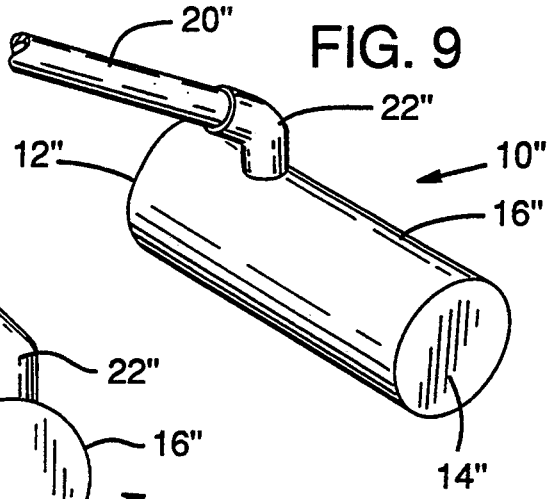
FIG. 9. is a fragmentary isometric view taken from the rear of the FIG. 6 embodiment.
Figure 8:
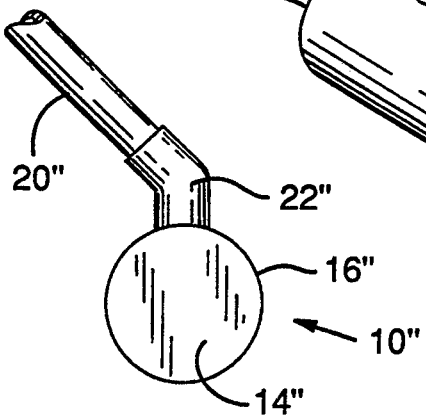
FIG. 8 is a rear elevational view of the FIG. 6 embodiment.
Figure 10:
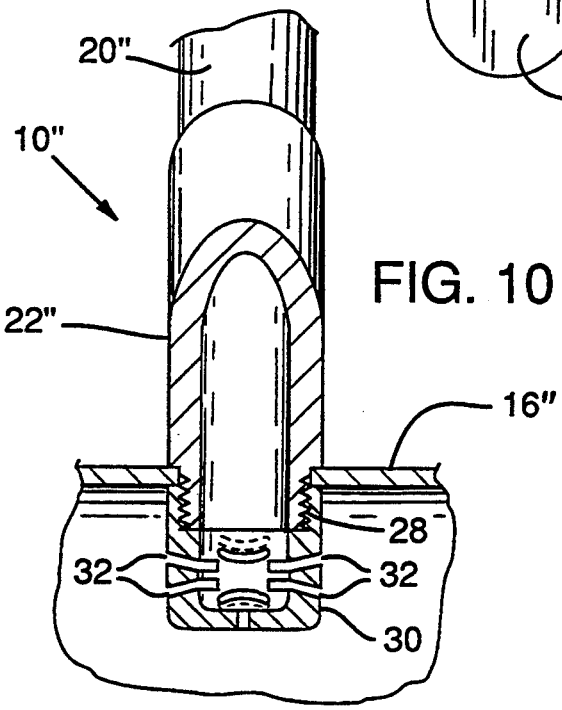
FIG. 10 is an enlarged fragmentary sectional view taken on the line 10—10 of FIG. 7.
Figure 11:
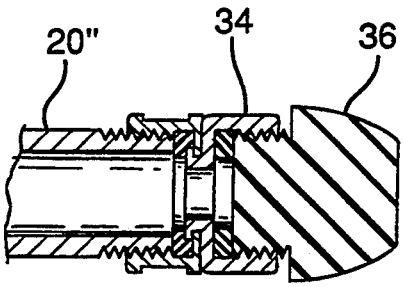
FIG. 11 is an enlarged fragmentary sectional view taken on the line 11—11 of FIG. 6.

With reference to FIGS. 6–11, which shows still another embodiment of the invention, the receptacle 10" has a forward open end 12" a closed rearward end 14" and circular defining side wall 16". The side wall in this embodiment is fully closed.

Handle 20" and elbow connection 22" have the same relationship as that shown in detail in the FIG. 1 embodiment, namely, the handle leads rigidly from a side wall of the receptacle in a lateral direction adjacent the front end and at approximately a 45° angle relative to the receptacle, whereby when the receptacle is held adjacent the ground by a person at his or her side, the receptacle is horizontal to the ground and can be maneuvered to readily pick up an article by forward motion of the receptacle. Connection 22" projects a short distance into the receptacle, FIGS. 7 and 10, and supports by a threaded connection 28 a spray head 30 having ports 32 provided at selected angles for thorough cleaning of the interior of this receptacle. Some of the ports are directed toward the closed rear wall for flushing foreign material from the rearward portion, and some ports are also directed toward both sides and the front, including the open edge 12". The handle 20" is hollow to communicate with the projection 22" and the spray head 30, and the upper end of the handle 20" has a female hose fitting 34, FIGS. 6 and 11, adapted for connection to a garden hose. By pressured supply of water to the spray head 30 from the garden hose, the inside of the device can be automatically washed clean. The embodiment of FIGS. 6–11 serves well as a pickup scoop for dog excrement. A threaded plug 36 is provided for closing the free end of the handle when the device is in use without a hose connected thereto, or when in storage.

It is to be understood that the forms of my invention herein shown and described are to be taken as preferred examples of the same and that various changes in the shape, size and arrangement of parts may be resorted to without departing from the spirit of my invention or the scope of the subjoined claims.

Having thus described my invention, I claim:

1. A device for scooping articles from the ground surface comprising:

a cylindrical receptacle having front and rearward ends and defining side, top and bottom walls forming an inner walled surface with said rearward end, said front end being open and said rearward end being closed, and an elongated handle on said receptacle, said handle having a lower end leading rigidly from said receptacle to an outer gripping end for gripping and manipulation by a person in a forward motion of the receptacle to scoop articles into said front open end for collection in said receptacle, said handle comprising a first portion at its said lower end projecting vertically in diametral alignment from the tom wall of said receptacle to an outer end spaced from said receptacle, said handle having an elongated second portion leading from the outer end of said first portion laterally of said receptacle at an angle of approximately 45° relative to said first portion wherein said receptacle is capable of being suspended from said first portion adjacent the ground by a person gripping said handle, said receptacle, when manipulated longitudinally by the person relative to the ground and when tilted to the horizontal by rotation of said second portion, maintaining a straight ahead alignment with the direction of longitudinal movement to pick up articles on the ground by a forward selected tilted position during operation thereof.

2. The device of claim 1 including openings in said side wall of a size less than articles to be picked up to allow foreign material to be shaken out, said openings having edge portions against which the picked up articles rest for keeping the articles from rolling out said front open end while picking up more articles.

3. The device of claim 2 wherein said openings extend longitudinally in said side wall and are of a length greater than one-half the length of the receptacle.

4. The device of claim 1 wherein said front open end comprises a fluted edge facilitating scooping reception of an article from a smooth surface.

5. A device for scooping articles from the ground surface comprising:

a cylindrical receptacle having front and rearward ends and defining side walls forming an inner walled surface with said rearward end, said front end being open and said rearward end being closed, and an elongated handle on said receptacle, said handle having a lower end leading rigidly from a side wall of said receptacle forward of the center of gravity of the receptacle for gripping and manipulation by a person in a forward motion of the receptacle to scoop articles into said front open end for collection in said receptacle, said handle projecting laterally of said receptacle at an angle of approximately 45° relative to a vertical diameter of said receptacle whereby when said receptacle is supported adjacent the ground by a person gripping said handle, said receptacle can be maneuvered relative to the ground to pick up articles on the ground by a forward scooping movement, said handle being hollow and communicating at its lower end with the interior of said receptacle, said handle having an upper end with connecting means capable of attachment to a garden hose for admitting pressured streams of water to the interior of said receptacle for cleaning the interior, said handle terminating in a spray head with jet outlets directed against the front, rear and sides of said walled surface of said receptacle.

* * * * *